United States Patent [19]

Tomiyori et al.

[11] Patent Number: 4,505,073

[45] Date of Patent: Mar. 19, 1985

[54] APPARATUS FOR SORTING POWER TRANSMISSION BELTS

[75] Inventors: Takashi Tomiyori, Kobe; Misao Fukuda, Hyogo; Iwao Yamashita, Hyogo; Nobuo Simizu, Hyogo; Takeshi Kumano, Hyogo, all of Japan

[73] Assignee: Mitsuboshi Belting Ltd., Kobe, Japan

[21] Appl. No.: 485,458

[22] Filed: Apr. 15, 1983

[30] Foreign Application Priority Data

Apr. 17, 1982 [JP] Japan ..... 57-64447

[51] Int. Cl.[3] ..... B24B 49/02; B07C 5/07

[52] U.S. Cl. ..... 51/165 R; 51/165.91; 51/215 H; 51/326; 33/147 E; 209/538; 209/552; 209/556; 209/604

[58] Field of Search ..... 209/509, 538, 552, 555, 209/556, 558, 598, 600, 601, 604; 51/165 R, 165.91, 215 CP, 215 H, 326; 33/147 N, 147 E, 147 R, 172 E, 174 L; 364/468, 474, 505-507

[56] References Cited

U.S. PATENT DOCUMENTS

| | | | |
|---|---|---|---|
| 2,748,936 | 6/1956 | Arlin | 209/538 |
| 2,854,757 | 10/1958 | Roeger | 33/174 L |
| 2,905,320 | 9/1959 | Gates | 51/165 R X |
| 2,949,676 | 8/1960 | Finnegan et al. | 51/165 R X |
| 3,049,978 | 8/1962 | Miles et al. | 209/598 X |
| 3,391,462 | 7/1968 | Craine | 33/143 M |
| 3,774,312 | 11/1973 | Esch | 33/174 L |
| 3,822,516 | 7/1974 | Huber | 51/326 |
| 3,841,033 | 10/1974 | Appleby et al. | 51/165.91 X |
| 3,965,580 | 6/1976 | Bogart et al. | 33/143 M |
| 4,322,916 | 4/1982 | Richmond | 51/326 X |
| 4,413,418 | 11/1983 | Anderson et al. | 33/147 R X |

*Primary Examiner*—David A. Scherbel
*Assistant Examiner*—Edward M. Wacyra
*Attorney, Agent, or Firm*—Wood, Dalton, Phillips, Mason & Rowe

[57] ABSTRACT

An apparatus and method of sorting power transmission belts into groups of substantially equal length. The apparatus is entirely automatic and includes mechanism for transferring seriatim the respective belts from a supply to a measuring drive mechanism. The belt being measured is driven under tension and the length and rideout concurrently determined and fed to a computer. In the event the belt is found to be outsized but capable of being brought into the desired range by grinding the sides thereof, grinding mechanism of the apparatus is actuated to adjust the configuration suitably. The apparatus includes mechanism for discarding outsized belts which cannot be so adjusted. The apparatus includes mechanism for transferring the belts from the measuring drive system to a conveyor and associated mechanism for sorting the measured belts as a function of a signal provided by the computer.

20 Claims, 21 Drawing Figures

APPARATUS FOR SORTING POWER TRANSMISSION BELTS

DESCRIPTION

1. Technical Field

The present invention relates to automatic dimension check apparatus for use in the manufacture of power transmission drive belts, and more specifically, to such apparatus which sorts the measured belts into groups having similar belt length.

2. Background Art

Transmission belts, such as V-belts, are manufactured conventionally by a method in which the belt is molded in the form of a cylindrical sleeve which is cut to define a plurality of V-belts each having a trapezoidal cross section. The cut belts are vulcanized in a mold or vulcanized in the sleeve form before they are ground to the desired trapezoidal shape.

However, V-belts thusly manufactured often vary in length and cross-sectional shape depending on a number of factors, including thermal contraction of materials, incorrect tension, or processing errors at the time of grinding, etc.

Such variations in the length of the belts has required additional tension apparatus in the drive mechanism. Errors in the cross-sectional shape not only undesirably affect the length, but further cause the belt position to vary in the radial direction with respect to the pulley center when the V-belt is engaged with the pulley in the peripheral groove thereof. Such inaccurate fit gives rise to belt vibrations, belt tension variations during belt travel, and undesirable vibration of the drive mechanism.

Further, where multiple V-belts are used with pulleys having a plurality of side-by-side belt grooves, high belt length accuracy is required for equalization of the tension applied to the respective belts, to prevent excessive wear resulting from positional variations of the respective belts in the pulley grooves, and maintain high transmission efficiency and low power loss. Accordingly, it is common practice for the user to select belts with the same length (pulley center-to-center distance) for use in such multiple belt drive systems.

One conventional method of sorting such belts comprises entraining the V-belts around a fixed measuring pulley and a movable measuring pulley to which a constant load is applied. Tension is applied to the belt and, with the fixed pulley being rotated, the operator checks the length of the belt.

Common causes for outsized belts include:

(1) the upper surface and lower surface width dimensions of the V-belt are too large for the V-belt to be received properly in the pulley groove. Subsequently, the rideout, i.e. the spacing between the belt upper surface and the pulley circumferential surface, is excessive;

(2) the upper and lower surface width dimensions of the V-belt are too small; thus, the V-belt is received in the pulley groove too deeply, making the rideout too small; and (3) the pulley outside length is outside a specified range notwithstanding the rideout value being within the specified range.

In the conventional transmission belt dimension measuring apparatus, the V-belt is manually installed onto the measuring pulleys. The operator must subsequently manually remove the measured V-belt. Thus, a considerable amount of time is required to measure or check each V-belt.

Further, in the conventional method, judgment as to whether a V-belt is to be accepted or rejected differs depending on the operator's skill. Furthermore, V-belts rejected because of large rideout can often be made acceptable by grinding the belt sides, and thus, the operator was required to further sort the belts. As there are many causes of such V-belt rejections, the operator not only had to spend substantial time to determine these causes, but also had to be highly skilled.

DISCLOSURE OF INVENTION

The present invention eliminates the disadvantages of the conventional belt dimension checking systems and apparatuses by providing a novel automatic belt checking system and apparatus.

The belt dimension checking apparatus of the present invention automatically detects the pulley center-to-center distance corresponding accurately to the length of V-belt entrained thereabout and the rideout. The apparatus is provided with mechanism for grinding the V-belt sides as needed.

Broadly, the invention is concerned with provision of an automatic V-belt dimension checking apparatus having a belt sorting mechanism for sorting the measured V-belts in groups of similar belt lengths. Sorting of the measured belts is automatically effected.

One feature of the invention resides in the belt dimension checking apparatus automatically detecting the rideout, pulley center-to-center distance and variations thereof with the V-belt entrained about two measuring pulleys and driven under tension.

The apparatus further includes means for removing the measured V-belt, a novel belt measuring mechanism for sorting the belts. The sorting means includes rails laid in a loop, one or more belt falling sections secured thereto, conveyors which swivel discontinuously and at a fixed pitch along said rails, and one or more belt carriers secured to said conveyors. The belt falling sections receive the respective belts of similar belt length. The respective belt falling sections comprise a movable rod which protrudes perpendicularly to the belt carrier traveling direction. The rod of the belt falling section which receives the belts transferred from the belt inspection machine protrudes and moves when a V-belt corresponding to a preselected length is transferred. This rotates a belt hanger installed to the belt carrier to cause the V-belt to fall. Thus, the apparatus provides a mechanism for automatically sorting V-belts into groups of preselected belt lengths.

A specific embodiment of the invention is disclosed in the following specification and drawings.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
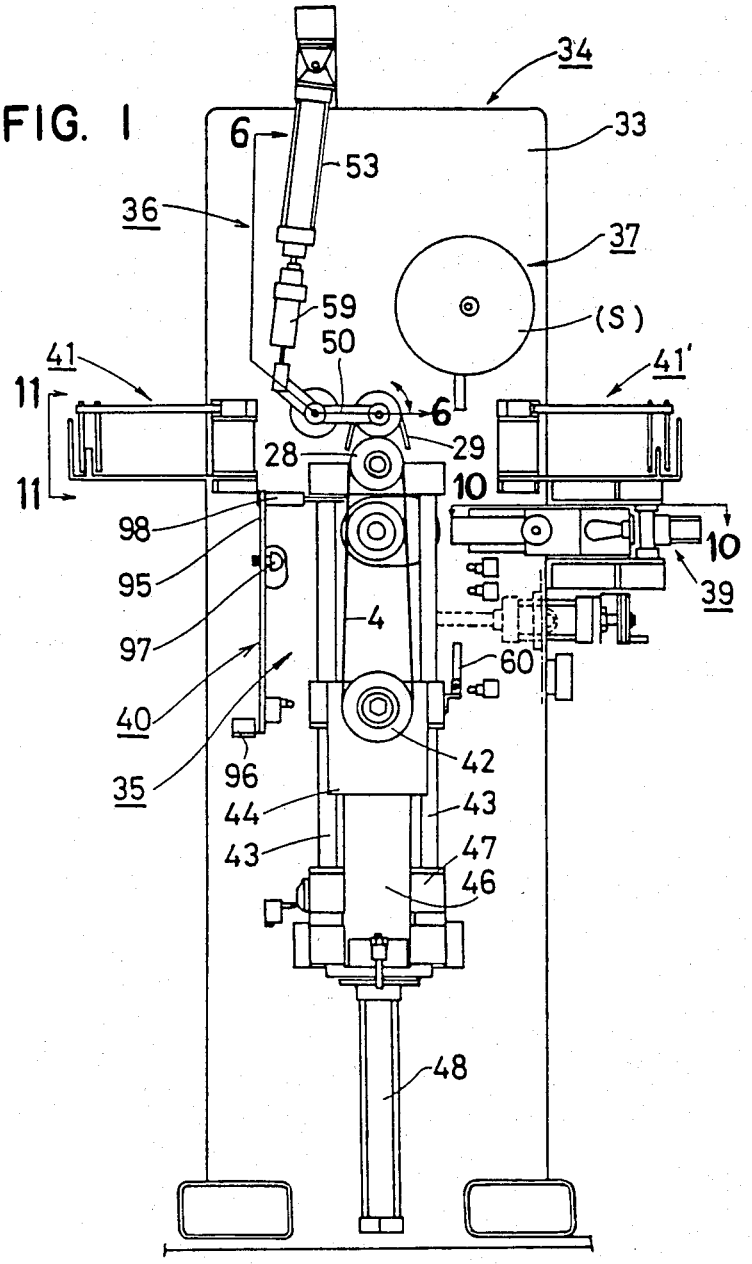
FIG. 1 is a fragmentary front elevation of an inspection machine embodying the invention for automatically sorting belts.
Figure 2:
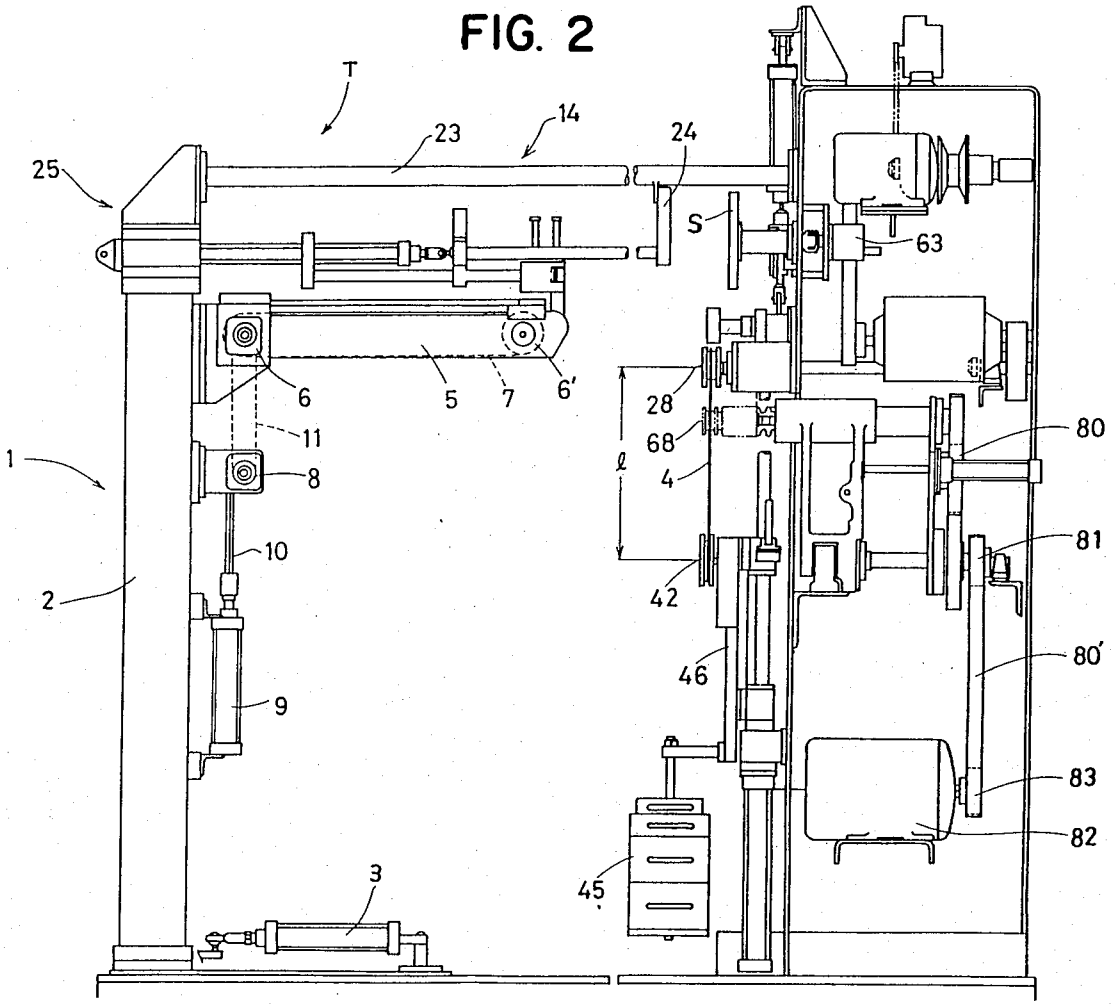
FIG. 2 is a side elevation thereof.
Figure 3:
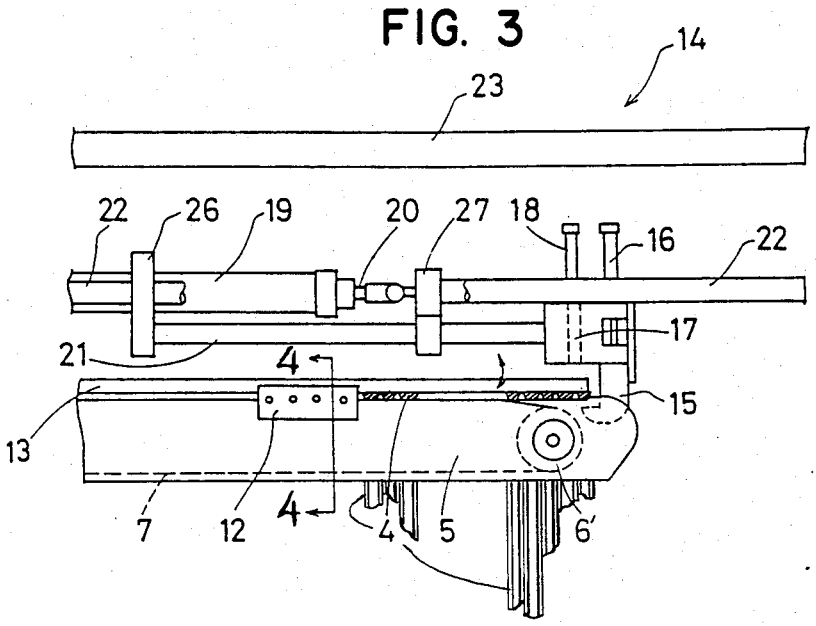
FIG. 3 is an enlarged fragmentary elevation of the belt feed and transport mechanism.
Figure 4:
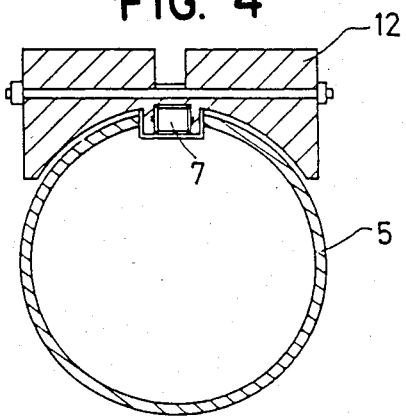
FIG. 4 is a transverse section taken substantially along the lines 4—4 of FIG. 3.

In the exemplary embodiment of the invention as disclosed in FIGS. 1-4 of the drawing, a belt checking device is shown to comprise means for automatically measuring V-belts. The apparatus includes a series of devices, or mechanisms, including a belt supply mechanism and a belt transport mechanism. As seen in FIG. 2, a belt installation mechanism T comprises a mechanism which supports unmeasured V-belts and automatically feeds them onto a measuring pulley having a belt supply section 1 and a belt transport section 14. In said belt supply section 1, an upright support post 2 is rotated by means of a cylinder 3. Post 2 is provided with a surrounding cylindrical belt support section 5 which supports the unmeasured V-belt 4. For measuring a plurality of belts, however, the belt support section comprises a plurality of portions installed around the post at fixed intervals. Belt support section 5 supports a plurality of unmeasured V-belts 4 and is provided with a transport mechanism which feeds the belts to tne end of support section 5 in a given period of time at a fixed distance. Two gears 6 and 6′ are provided at the ends of belt support section 5 for association with a drive chain 7. A gear 8 and a cylinder 9 are secured to the post 2. Gear 8 is engaged with a rack 10 installed to the cylinder 9, and a drive chain 11 is entrained between gears 8 and 6. Consequently, when rack 10 moves upwards by means of the cylinder operation, gear 8, which is in mesh with rack 10, rotates in the proper direction to cause chain 7, which stays inside belt support section 5, to rotate in the proper direction to cause an unmeasured V-belt 4 to move laterally toward the end of belt support section 5. As shown in FIG. 4, a belt push plate 12 is provided on the surface of the cylindrical belt support section 5 and is secured to chain 7.

Belt push plate 12 moves with chain 7 and functions to move the unmeasured V-belts in parallel relationship. A belt holding rod 13 has its ends mounted to belt support section 5 and moves in the arrow direction shown in FIG. 3. Rod 13 is arranged to urge push plate 12 against the rear of the lefthand V-belt 4 after the V-belt is in parallel to belt support section 5 to maintain proper relationship of the V-belts as they are moved to the transfer position.

A belt transport section 14 transfers the V-belts from the belt support section to the measuring pulleys and includes mechanism for automatically picking up the righthand V-belt falling from the belt support section 5 and transferring it onto the measuring pulleys.

An L-shaped belt holding section 15 is moved up and down by action of cylinder 16. Immediately before the lead V-belt on belt support section 5 falls, belt holding section 15 is moved downwardly to receive this V-belt, and after receiving the belt to be transferred, is moved upwardly. A rod 17 is coupled to a cylinder 18 in parallel with belt holding section 15 for translating belt holding rod 13.

Belt holding section 15 is coupled indirectly to a piston rod 20 of a cylinder 19, as shown in FIG. 3. An auxiliary rod 21 is coupled to the belt holding section 15. Two guide rods 22, arranged in parallel, are connected to a support plate 24 secured to a fixed rod 23, and secured to a rod installation section 25. Rod 21 is fixed to two slide plates 26 and 27 slidable on the two guide rods 22. Piston rod 20, which is coupled to cylinder 19 disposed between guide rods 22, is secured to slide plate 26. When piston rod 20 moves to the right, as seen in FIG. 3, belt holding section 15 moves to adjacent the measuring drive V-pulley 28 and automatically installs the belt onto the pulley.

Figure 5:
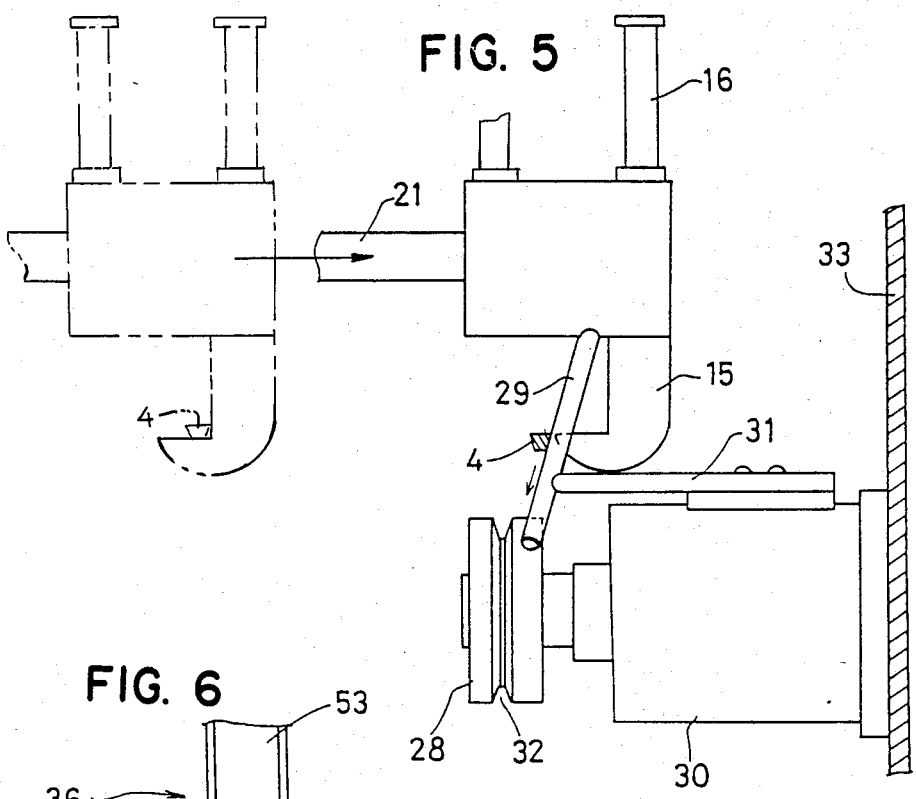
FIG. 5 is a fragmentary side elevation of the belt insertion guide illustrating the insertion of a V-belt onto the measuring drive pulley.

As seen in FIG. 5, the mechanism provided for setting the V-belts onto the measuring drive V-pulley includes a belt setting guide 29 fixed to a support rod 31 secured to a support base 30 of measuring drive V-pulley 28.

Belt setting guide 29 has a barlike shape as shown, and is inclined with respect to support rod 31. The lower end of guide 29 is adjacent measuring drive V-pulley 28, as shown. When belt holding section 15 moves to over belt setting guide 29, V-belt 4 carried thereby is caught in belt setting guide 29, thus causing it to automatically engage groove 32 of pulley 28 by sliding downwardly on guide 29 in the direction of the arrow in FIG. 5.

Rod installation section 25, as shown in FIG. 2, is slid on post 2. Fixed rod 23 is secured to rod installation section 25 and a front frame 33 of the belt measuring section.

Belt checking mechanism 34 is shown in FIG. 1 to comprise a V-belt drive section 35 in which the transferred V-belt is installed about the measuring V-pulleys 28 and 42. A rideout detector 36 automatically detects rideout of the installed V-belt. A pulley outside surface detector 37 detects the center-to-center distance l between the measuring V-pulleys 28 and 42. A belt processing section 38 is provided for grinding the sides of oversized V-belts. A push roll section 39 presses against the rear of the V-belt during such grinding. A belt push-out section 40 removes the measured V-belt from the measuring drive pulleys to a belt catching section 41.

V-belt drive section 35, as discussed above, includes a measuring drive pulley 28 for driving the V-belt and a measuring driven pulley 42 which applies a constant tension to the driven V-belt. Measuring driven pulley 42 is secured to a slide body 44 which moves up and down along two parallel, vertical guide rods 43. A weight 45 for applying tension to the V-belt is coupled to the slide body 44 through a plate 46.

A second slide body 47 is fixed to plate 46 for moving the plate up and down along guide rods 43.

Measuring driven pulley 42 is moved up and down by a cylinder 48 coupled to slide body 47. During installation of the V-belt in the drive section 35, measuring driven pulley 42 is moved toward measuring drive pulley 28, and after the belt is installed, is moved downward to apply tension to the V-belt. The V-belt is then driven by rotation of measuring drive V-pulley 28.

Figure 6:
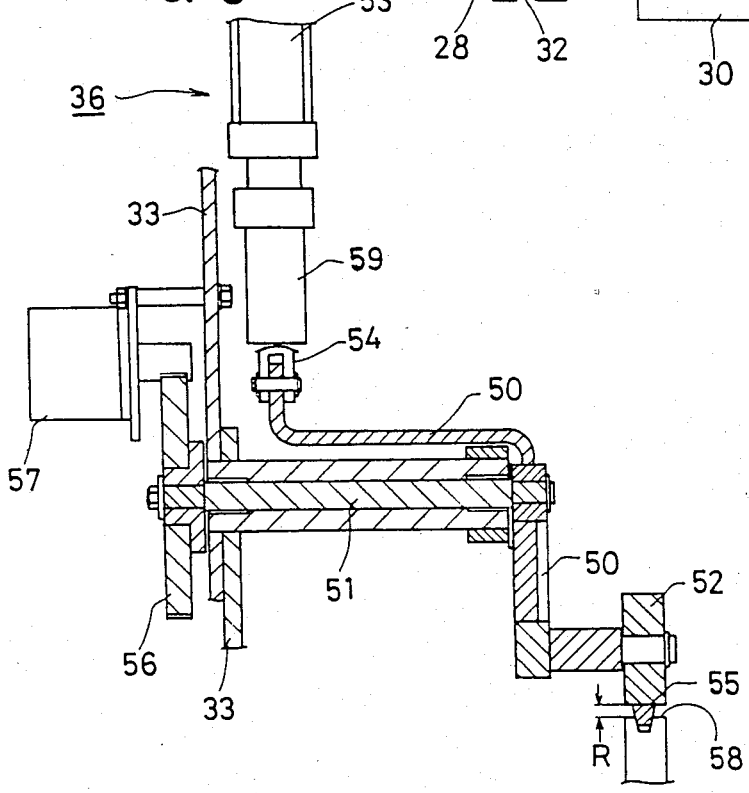
FIG. 6 is a section taken substantially along the line 6—6 of FIG. 1 illustrating in greater detail the rideout detector.

Rideout detector 36 is shown in greater detail in FIG. 6. As shown, an arm 50 is mounted to a rotating rod 51. One end of arm 50 is connected to a cylindrical roller 52 and the other end is connected to a rod 54 coupled to a cylinder 53. Thus, when rod 54 is moved downwardly by cylinder 53, the roller 52 rotates in the direction of the arrows in FIG. 1 about the axis of rotating support rod 51. As shown in FIG. 6, the roller 52 facially engages the outer surface 55 of the V-belt.

A gear 56 is mounted to the opposite end of the rotating support 51 inside front frame 33. A pulse generator 57 is provided thereon to detect rotation of gear 56.

When roller 52 swivels about the axis of the rotating support 51 and rotates in engagement with the outside surface 55 of the driven V-belt, gear 56 is rotated, whereby the rideout R of the belt in pulley 28 is detected by pulse generator 57. The rotating roller 52 is caused to move slightly upwardly or downwardly, and the spacing between the outside surface 55 of the belt and the outside surface 58 of measuring drive pulley 28 is detected as rideout R by pulse generator 57.

As seen in FIG. 1, a pressure regulator 59 is provided for urging the outside surface 55 of the V-belt against the flat roller 52 with a preselected pressure. As shown, regulator 59 is connected between the piston cylinder 53 and arm 50.

Figure 7:
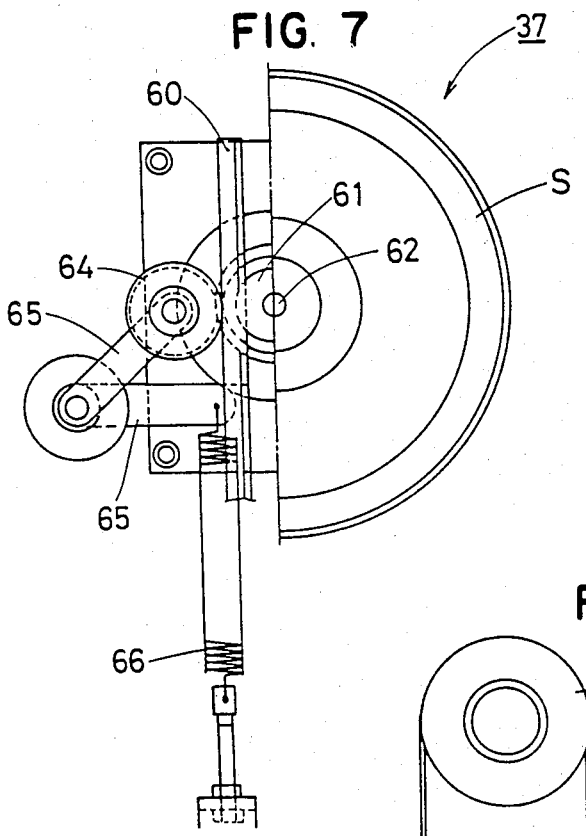
FIG. 7 is a fragmentary front elevation of the pulley outside surface detector.

The pulley outside circumference detector 37 is shown in greater detail in FIGS. 2 and 7. As shown, a rack bar 60 has its lower end fixed to slide body 44 of measuring driven pulley 42, and thus, moves in accordance with the vertical movement of measuring driven pulley 42. A gear 61 is fixed to a shaft 62 to mesh with rack bar 60. At the end of shaft 62, outside of front frame 33, an indicator plate S is mounted to indicate the movement of rack bar 60. At the other end of shaft 62 is provided a pulse generator 63 (see FIG. 2) which automatically detects the variable pulley center-to-center distance l resulting from movement of rack bar 60.

As further shown in FIG. 7, a tension roller 64 supports and biases rack bar 60. Tension roller 64 is carried on one end of a linkage 65 biased about a pivot axis by a coil spring 66.

Pulley outside circumference detector 37 comprises a mechanism automatically detecting movement of measuring driven pulley 42 in applying tension to the belt during drive of the belt. More specifically, detector 37 measures constantly the variable center-to-center distance l between pulleys 28 and 42.

Belt processing section 38 provides means for automatically grinding the V-belts when necessary to bring them to an acceptable configuration and effective length. Thus, where the detected rideout value is greater than the set preselected limit, and the pulley center-to-center distance l is smaller than the preselected limit, or the variation of the pulley center-to-center distance l is greater than the preselected range, the apparatus automatically adjusts the belt cross section to bring the belt to the desired length range.

Figure 9:
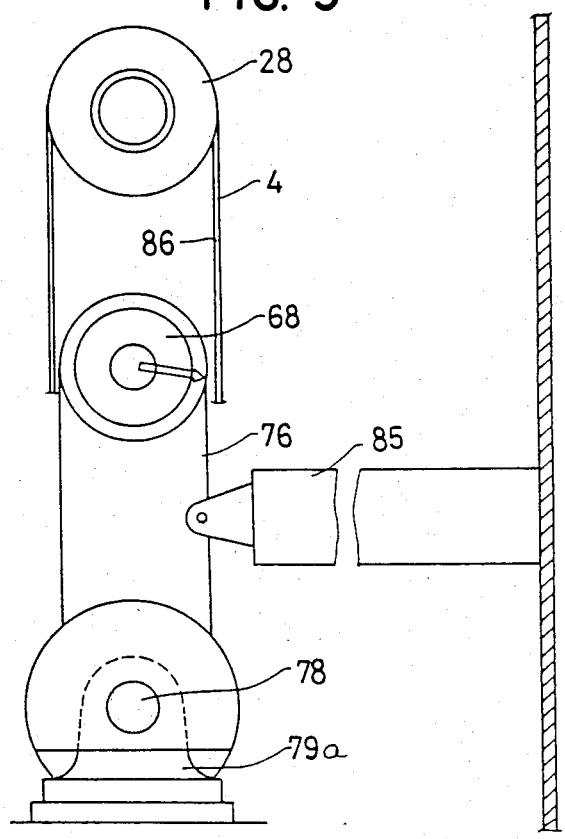
FIG. 9 is a fragmentary elevation of the belt processing section illustrating an initial stage of the belt checking process.
Figure 8:
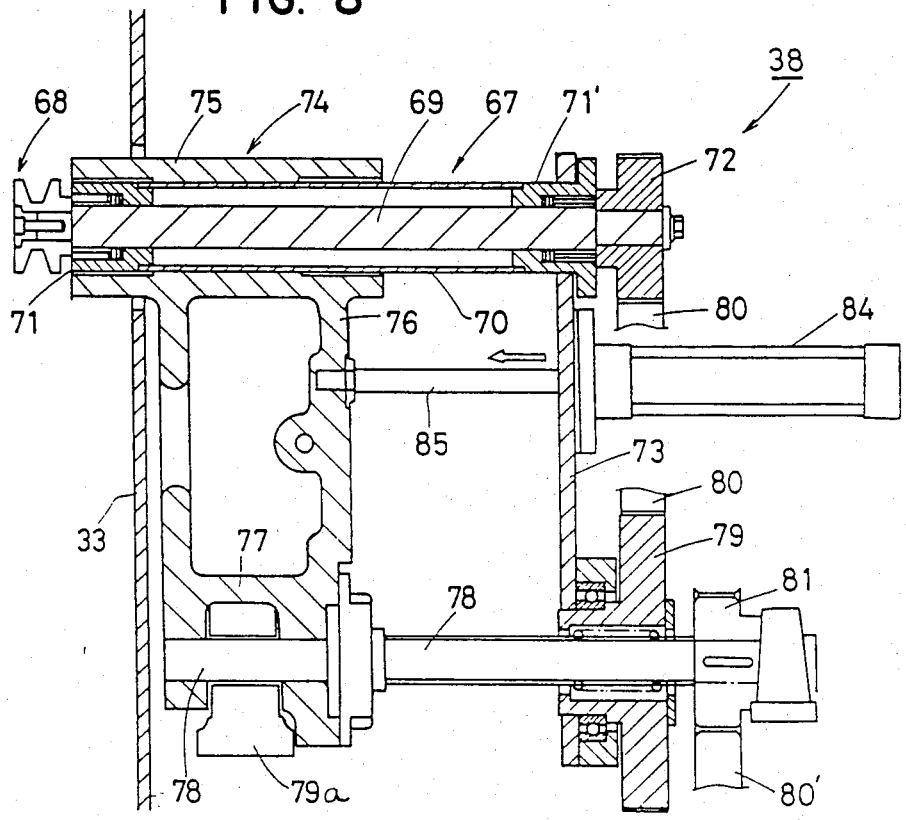
FIG. 8 is a fragmentary section of the belt processing section.

As shown in FIGS. 8 and 9, the grinder mechanism 67 includes a grinder 68, an upper shaft 69, and a sliding cylinder 70. The grinder 68 is arranged to grind the belt sides and comprises a suitable grooved grindstone secured to upper shaft 69. Upper shaft 69 is supported by bearings 71 and 71' at its opposite ends. A pulley 72 is mounted to one end. Bearing 71 is secured to sliding cylinder 70 which coaxially surrounds upper shaft 69. The other bearing 71' is carried by a movable support structure 73.

A fixed support structure 74 comprises a tubular part 75 supporting grinder mechanism 67, leg 76, and a bearing 77 on a support base **79*a* through a lower shaft 78**.

Movable support structure 73 carries a movable pulley 79 and lower shaft 78. Pulley 79 rotates with lower shaft 78 and is axially movable thereon.

As seen in FIGS. 2 and 8, toothed belts 80 and 80' are engaged with pulleys 72 and 79. A pulley 81 is installed to the end of lower shaft 78, and a pulley 83 is provided on the drive shaft of a motor 82, whereby grinder 68 is rotated by the motor.

Thus, from the position shown in FIG. 8, movable support structure 73 is moved in the direction of the arrow along a guide rod 85 by action of a cylinder 84. At the same time, grinder 67 and pulley 79 move in parallel to cylinder 75 of fixed support structure 74 and lower shaft 78 respectively, thus causing grinder 68 to adjacent the V-belt.

As shown in FIG. 9, there is initially a gap between the grinder and the V-belt. Cylinder 84 is installed at leg part 76 of fixed support structure 74. Thus, when leg part 76 is moved in the direction of the arrow in FIG. 9 by cylinder 84, grinder 68 swings about shaft 78 pivotally mounting the leg part so that the grinder is engaged with the inner portion 86 of the belt.

Figure 10:
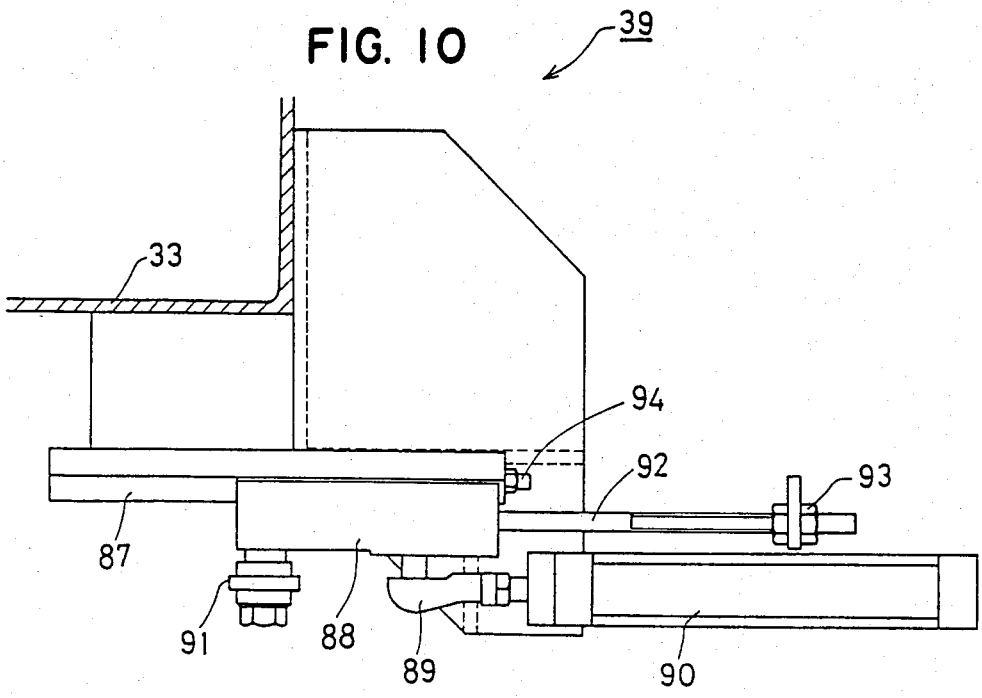
FIG. 10 is a fragmentary plan view of the push roll mechanism taken from the line 10—10 of FIG. 1.

Push roll section 39 urges the outer portion of the belt into the grinder V-groove to assure accurate grinding of the belt sides. As shown in FIGS. 1 and 10, a guide rail 87 carries a movable base 88 coupled to a cylinder 90 through a piston rod 89. A roller 91 engaging the outer portion of the belt is mounted to movable base 88. The range of movement of the roller is controlled by an adjusting screw 93 threaded onto a rod 92 fixed to movable base 88 to contact a stop 94 provided at the end of guide rail 87 at the limit of movement of roller 91.

Adjusting screw 93 and stop 94 accurately control the amount of grinding of the V-belt and cause it to have the desired cross section.

Push roll section 39 is installed to front frame 33. Belt pushout section 40 and belt catching section 41 automatically transfer the measured V-belt from the measuring pulleys. As shown in FIG. 1, the belt pushout section removes the V-belt from the measuring pulley 28.

An arm 95 is mounted to a bearing 96 provided in front frame 33. The arm is coupled to the piston rod of a cylinder 97 slightly above its center.

Arm 95 is moved forwardly about bearing 96 by means of cylinder 97. A belt push bar 98 provided at one end of arm 95 moves therewith to remove belt 4 from measuring drive pulley 28 after measuring driven pulley 42 has been raised and tension is removed from the belt.

Figure 11:
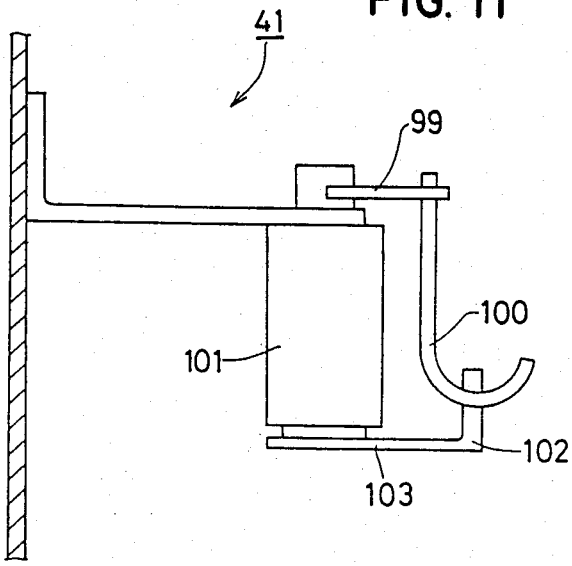
FIG. 11 is a fragmentary elevation taken along the line 11—11 of FIG. 1.

Belt catching section 41 is shown in FIGS. 1 and 11 to include an arm 99, at one end of which is provided a belt hanger 100 having a generally hook shape. The other end of the arm is secured to an upper part of an oscillating cylinder 101, under which an arm 103 provided with a stopper 102 is installed.

Belt hanger 100 is swiveled 180° by oscillating cylinder 101 to become disposed adjacent the measuring drive pulley 28 before the belt falls from pulley 28. After belt hanger 100 catches the belt, it returns 180° to its original position. However, movement of the belt therewith is interrupted by stopper 102 to remove the belt from the belt hanger.

Figure 12:
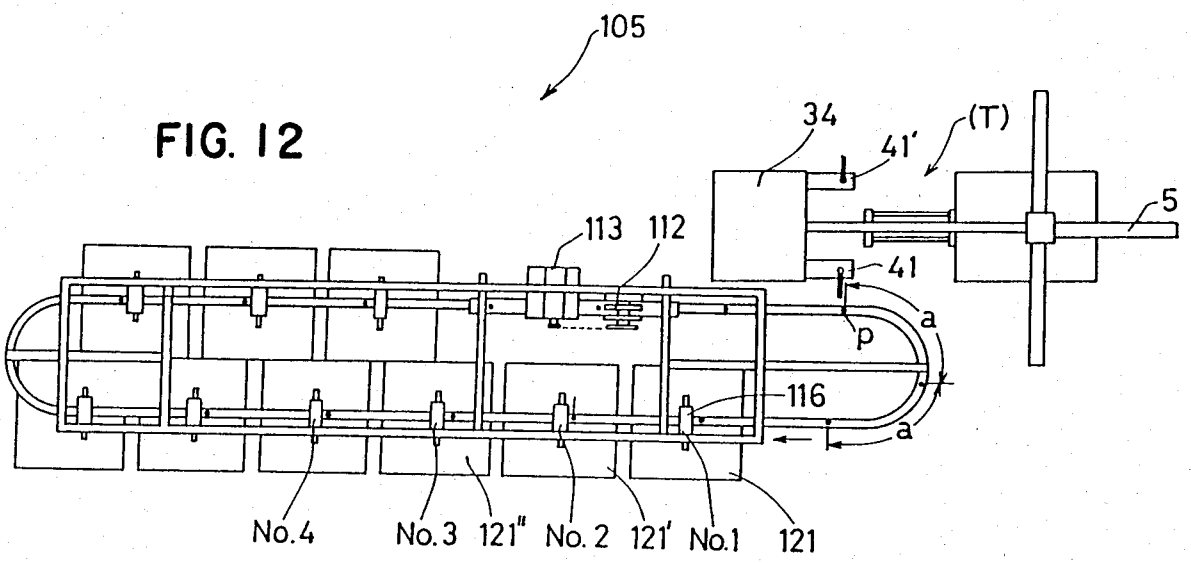
FIG. 12 is a top plan view of the belt classification mechanism.

FIG. 12 illustrates the overall arrangement of the apparatus 105.

Figure 13:
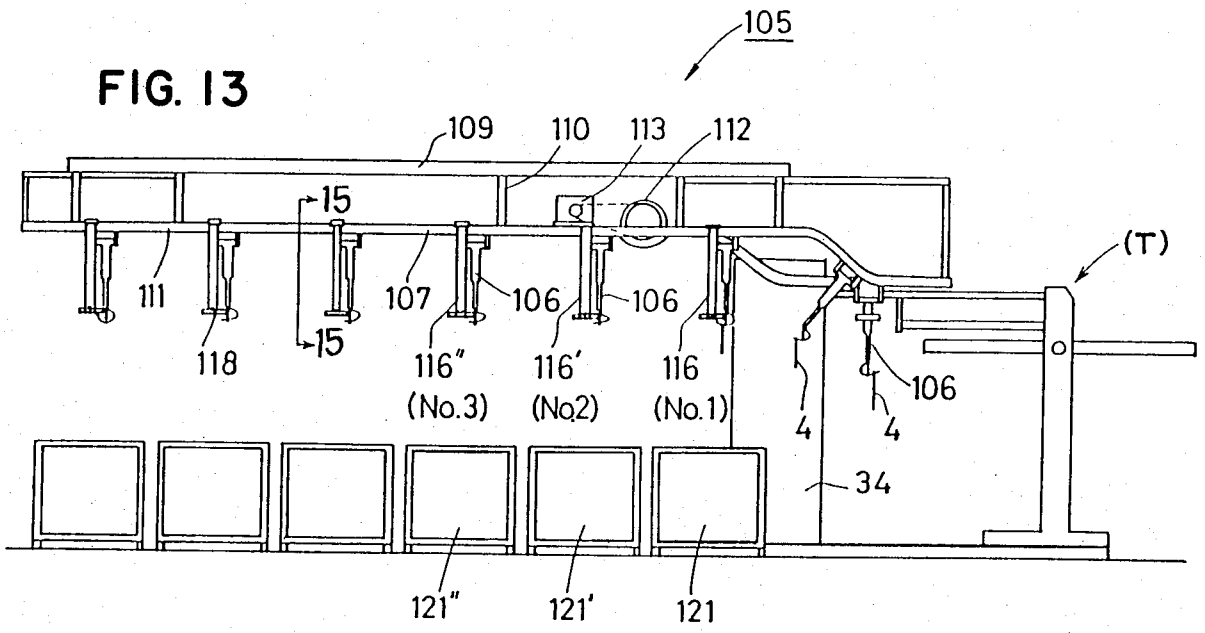
FIG. 13 is a front elevation thereof.
Figure 14:
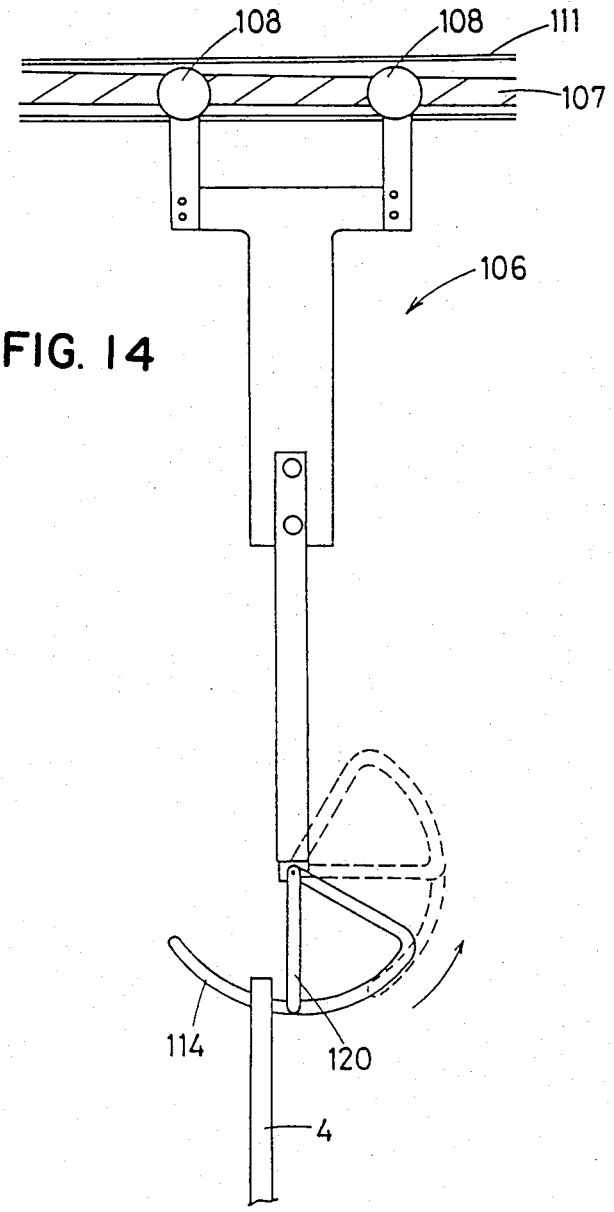
FIG. 14 is a front elevation of the belt carrier.
Figure 15:
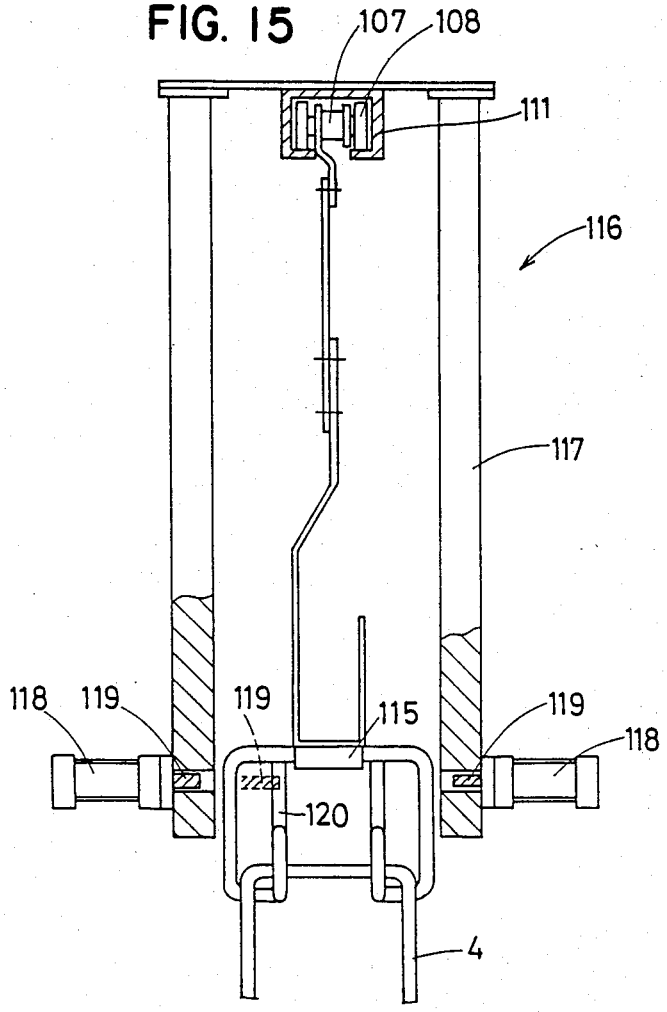
FIG. 15 is a fragmentary section taken substantially along the line 15—15 of FIG. 13.

In FIGS. 13 through 15, the belt sorting mechanism catches the measured V-belts transferred from belt catching section 41 and sorts them to preselected belt length groups.

As shown in FIGS. 12–15, a belt carrier 106 receives the V-belt from belt catching section 41. Belt carrier 106 is secured to a looped conveyor chain 107 at preselected intervals for travel with chain 107. Conveyor chain 107 is provided with rollers 108 at spaced intervals inside cylindrical rails 111 secured to a supporting structure 110 of a frame 109. The chain is engaged with a drive sprocket 112 provided on rails 111 to be driven in the direction of the arrow in FIG. 12 discontinuously by pitch with rollers 108 by a motor 113. Belt carrier 106 is caused to be stationary adjacent belt catching section 41 to receive the V-belt. After receiving the belt, it moves by a single pitch stroke (a) and is stopped until the next belt carrier (106) receives the next V-belt. Thus, each time a belt carrier 106 receives a falling V-belt, the carrier moves on by one stroke (a).

Belt carrier 106 is mounted to rollers 108 provided at chain conveyor 107, and is provided with a belt hanger 114 for holding the belt. The belt hanger is arranged to permit ready release of the V-belt as a result of swinging of the hanger about a shaft 115.

Belt falling sections 116, 116', 116'', etc., are provided on rails 111 at preselected intervals. A pair of opposed legs 117 are secured to rails 111, and a cylinder 118 is mounted at the outside of the lower end of the leg part 117. A rod 119 is coupled to cylinder 118 inside leg part 117 to protrude and move in a direction at right angles to the direction of travel of the belt carrier 106 from leg part 117 by cylinder 118, as shown in FIG. 15.

Belt falling section 116, allows cylinder 118 to actuate, causing plunger rod 119 thereof to protrude to adjacent a rod part 120 of the belt hanger, whereby the belt hanger rotates about the shaft 115, thereby allowing the V-belt to fall. The cylinders 118 are selectively controlled so that the hanger 114 is swung to release the belt at the stations No. 1, No. 2, etc., selectively. Thus, the cylinder 118 at station No. 1 is actuated only when a belt which has been determined to have a belt length in the range $\alpha$ passes. The belt falling section No. 2 is actuated only a belt in the belt length range of $\beta$ passes, and the belt falling section No. 3 is actuated only when a belt in the belt length range of $\gamma$ passes respectively, etc.

When the measured V-belt is received at the belt carrier located at the belt falling position P, the measurement data of the belt is transmitted to a conventional controller having a shift register mechanism. The controller actuates cylinder 118 to project rod 119 of the appropriate belt falling section to pivot the belt carrier holding the belt, thus causing the belt to fall and thereby be sorted with other such belts having a length in a preselected length. For example, when the belt carrier moves five strokes from the belt transfer position P, the controller causes cylinder 118 of belt falling section No. 3 to be actuated where it has been determined that the belt has a length within the preselected range corresponding to station No. 3. Similarly, if the next belt is determined to have a length in the range corresponding to station No. 1, the carrier travels three strokes from position P and the cylinder of belt falling station No. 1 is actuated to cause this belt to fall. Consequently, in each case, V-belts with lengths corresponding to different ones of the different preselected ranges corresponding uniquely with the respective belt falling stations No. 1, No. 3, No. 3, etc., are sorted into groups of belts each having a length in the respective ranges.

Industrial Applicability

In belt feed section 1, a plurality of V-belts 4 to be measured and sorted are suspended at the belt supporting section 5 so that they are located anteriorly to belt push plate 12. Post 2 is rotated to position this belt supporting section 5 directly under belt transport section 14. V-belts 4 are uniformly arranged by belt holding rod 13, and cylinder 9 provided adjacent support post 2 is actuated to cause gears inside the ends of belt supporting section 5 to rotate, whereby the belt push plate 12 secured to chain 7 is moved to cause the V-belts to fall one by one from the end of belt supporting section 5.

Belt holder 15 catches the falling V-belts sequentially and moves along guide rod 22 to adjacent measuring drive pulley 28 of the belt measuring section as a result of operation of cylinder 19, and places the V-belt onto the measuring drive pulley 28.

When the V-belt is engaged with the measuring drive pulley 28, the measuring driven pulley 42 moves downwardly and the V-belt is subjected to a preselected tension as it is driven by rotation of the measuring drive pulley 28. Simultaneously, flat roller 52 contacts the V-belt outer surface, causing rideout detector 36 and the pulley outside circumference detector 37 to operate.

The rideout value R of the belt and the variable pulley center-to-center distance l are detected by the pulse generator. If these values are determined to fall within a preselected range, measuring driven pulley 42 is automatically moved toward measuring drive pulley 28. The measured V-belt is separated from the measuring drive pulley 28 by the urging of belt push bar 98. When measuring drive pulley 28 stops rotating, and the measured V-belt is picked up by belt hanger 100 disposed adjacent measuring drive pulley 28, the belt is then caused to selectively drop from belt hanger 100 by the stop 102 of the appropriate section, thereby to sort the belts into preselected ranges of belt lengths in which its determined length falls.

On the other hand, if the rideout value R is determined to be greater than the preselected value, and the pulley center-to-center distance l is smaller than the preselected value, or the detected variations of the pulley center-to-center distance are greater than the set range, operation of the belt processing section 38 is initiated. The rotating grinder 68 is disposed adjacent the running V-belt causing it to engage the V-belt sides by operation of cylinder 84. At the same time, push roll section 39 is actuated to effect a proper grinding of the V-belt sides with roller 91 being urged against the outer surface of the V-belt.

If the rideout value, pulley center-to-center distance l, and variations thereof fall within the set parameters, drive pulley 28 stops rotating and roller 91 returns to its original position. Grinder 68 moves away from the V-belt and returns to its retracted position. The ground belt is then transferred and sorted in the same manner as described above.

Outsized V-belts which cannot be corrected by the grinding operation are transferred to the belt catching section 41' shown in FIG. 12.

Figure 16:
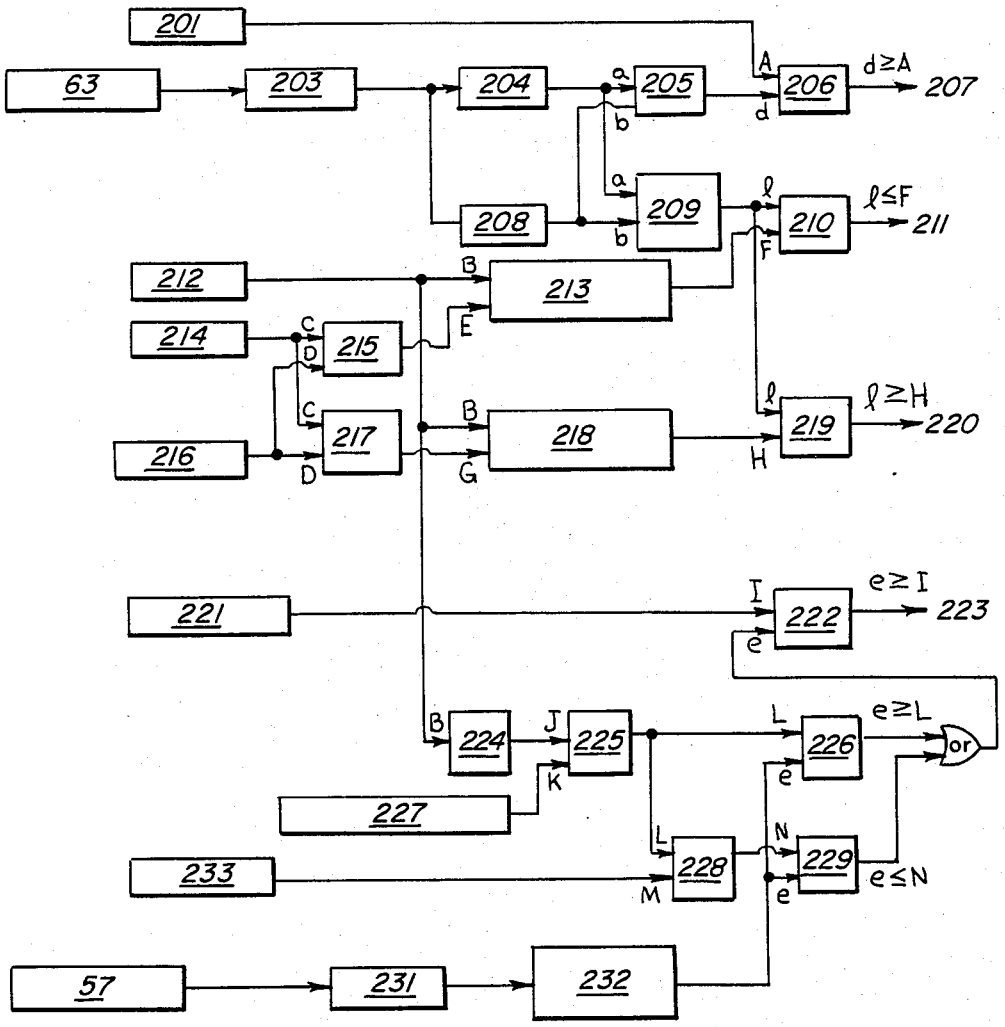
FIG. 16 is a block diagram illustrating the functioning of the detecting system.

FIG. 16 illustrates the overall operation of the detecting system for detecting the rideout value and the variations of the pulley outside circumference. The blocks identified by the 200-series numbers comprise:

201—deflection setter
202—pulse generator (63)
203—counter
204—MAX. detection
205—deflection value
206—comparison
207—deflection faulty
208—MIN. detection
209—center distance (l)
210—comparison
211—POC lower limit faulty $$\left[\left(b + \frac{a-b}{2}\right)\right]$$

212—pulley diameter setter
213—POC→center distance converter $$\left[\left(\frac{E - \pi s}{2}\right)\right]$$

214—POC setter
215—POC lower limit (C−D)
216—POC upper/lower limit setter
217—POC upper limit (C+D)
218—POC→center distance converter $$\left[\left(\frac{G - \pi B}{2}\right)\right]$$

219—comparison
220—POC upper limit faulty
221—rideout (R.O) setter
222—comparison
223—Rideout faulty
224—Radius B/2
225—Rideout lower limit (K−J)
226—comparison
227—Flat roller (52) movement setter
228—Rideout upper limit (L−M)
229—comparison
230—pulse generator (57)
231—counter
232—Angle-mm converter
233—upper limit setter The upper part of FIG. 16 relates to the pulley outside circumference detecting section. As shown, pulse generator 63 detects the movement of the measuring driven pulley 42 in applying tension to the V-belt, and the vertical movement of measuring driven pulley 42 during driving of the belt, i.e. the deflection as a pulley center-to-center distance l and variations of the center distance thereof.

The pulley outside circumference POC is measured between the pulleys, and the set range is predetermined according to the desired parameters.

Pulse generator 57 is a part of the rideout detecting section for detecting the spacing between the belt outside surface and the outside surface of the measuring drive pulley 28 as rideout R.O.

As further illustrated in FIG. 16, whether or not the belt grinding operation is required is effected by comparing the respective POC and R.O. preselected values and the detected values, and integrating these data.

When it is determined that the deflection is faulty, POC lower limit is faulty, POC upper limit is faulty, and R.O. is faulty, the belt processing section is actuated in accordance with the following schedule:

| POC: Less than lower limit | | | | POC: Good | | | |
|---|---|---|---|---|---|---|---|
| Deflection faulty | | Deflection good | | Deflection faulty | | Deflection good | |
| R.O. large | R.O. small | R.O. large | R.O. small | R.O. large | R.O. small | R.O. large | R.O. small |
| Necessary | Unnecessary | Necessary | Unnecessary | Necessary | Unnecessary | Necessary | Unnecessary |
| Acceptable according to correction | Uncorrectable | Acceptable according to correction | Uncorrectable | Acceptable according to correction | | | |

"Necessary" and "Unnecessary" in the table above refer to whether belt processing is required or not.

A POC greater than a preselected upper limit means the belt is "defective", and no belt processing is to be effected.

In FIG. 16, the belt is also considered faulty if the measured value is equal to the preselected limit value. For example, in the case of "Deflection", the deflection is acceptable if it is less than the preselected value A, but unacceptable if it is equal to the value A.

Thus, even if the rideout value, etc., does not fall within the set range, V-belts may be automatically made acceptable by grinding them, as discussed above.

The V-belts fall from belt catching section 41 to pass through belt classification mechanism 105. The V-belts are received by belt carrier 106 under belt catching section 41. Belt carrier 106 moves one stroke (a). The carrier moves a second stroke when the following belt carrier 106 receives a measured V-belt.

The respective belt falling sections 116 receive the data concerning the measurements of the V-belts sent from the belt inspection mechanism 34 so that when a belt falls within the appropriate length range, the cylinder 118 of the appropriate belt falling section is actuated by the control system shift register mechanism to extend the appropriate plunger rod 119, whereby the V-belts are sorted into the groups at stations 121,121',121'', etc., after they have been caused to drop from the carrier by the rotation of the belt hanger 114.

Figure 17:
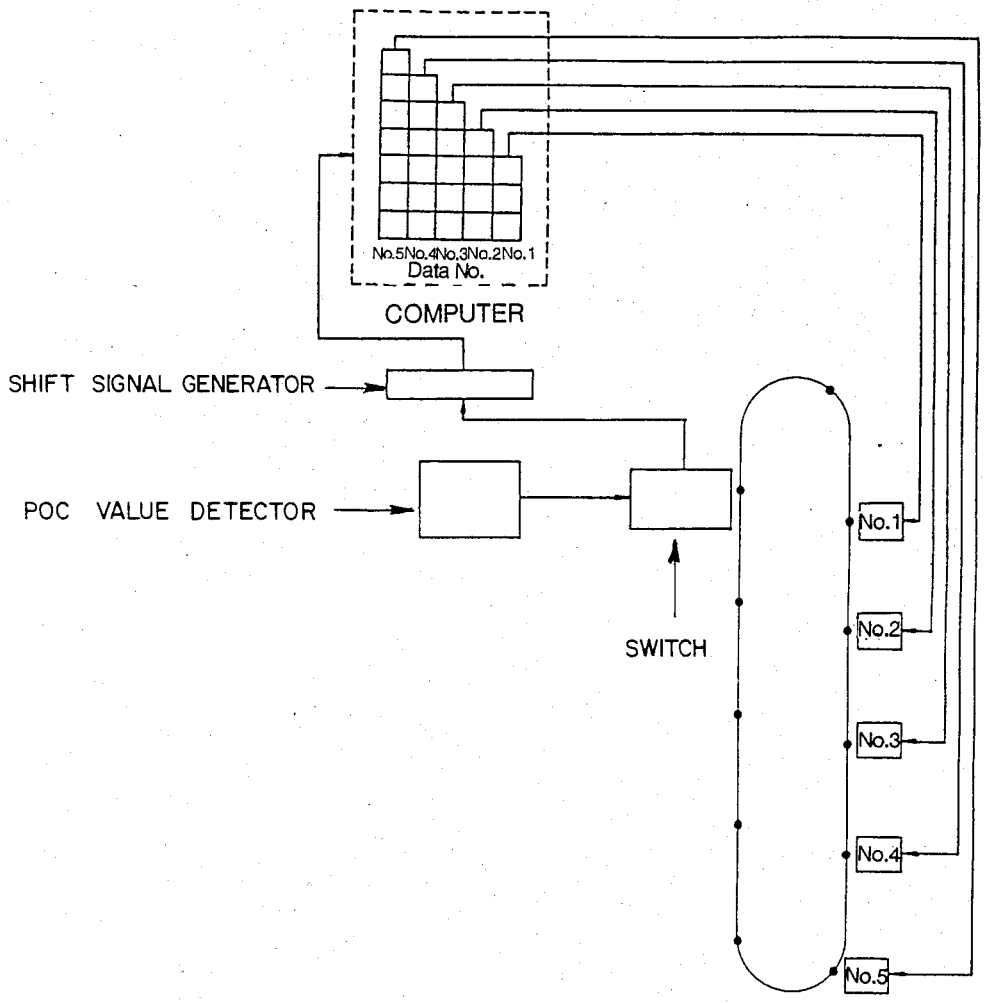
FIG. 17 is a schematic diagram illustrating in greater detail the operation of the detecting system.
Figure 18A:
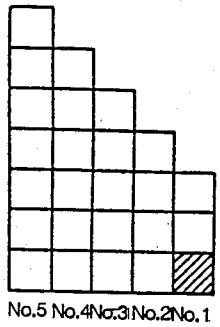
FIGS. 18(*a*)-(*d*) is a chart diagram illustrating in greater detail the operation of the control mechanism.
Figure 18B:
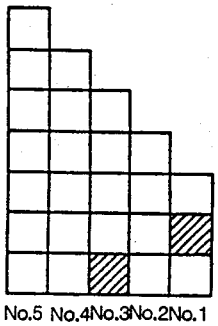
Figure 18C:
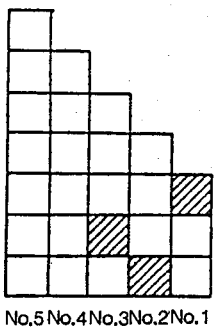
Figure 18D:
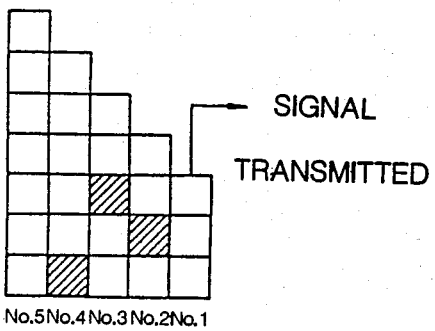

FIGS. 17 and 18 are schematic operation system diagrams illustrating operation of the controller having a shift register mechanism for automatic classification of the belts by the classification mechanism. When a belt carrier receives a belt corresponding to the belt falling section No. 1, the switch is turned ON by the falling belt, and this belt POX value is introduced to the data No. 1 of the computer by the shift signal generator. (See FIG. 18(*a*)).

The belt carrier receives No. 2 (FIG. 18(*c*)) and No. 4 (FIG. 18(*d*)) belts in sequence. At this time, the V-belt which has falled earlier in FIG. 18(*a*) moves three strokes, and a signal is transmitted from the computer to the belt falling section No. 1 to thereby actuate the cylinder of the belt falling section No. 1, thus causing said belt to drop.

Thus, such operations are repeated to allow the aforementioned classification, and the belts are automatically sorted into the corresponding cases by belt length.

Not only is the dimension checking apparatus operated automatically, but also the feed, transfer and sorting means are coordinated therewith and generated automatically. Thus, after an unmeasured V-belt is located at the belt supporting section, the belt supporting section is positioned directly under the belt transport section. The V-belt is transferred automatically from the belt supporting section to the belt holding section, and moves up to the belt setting guide of the belt holding section to be placed onto the measuring drive pulley.

When the V-belt is placed onto the measuring drive and driven pulleys and driven, the rideout detector and pulley outside circumference detector are automatically actuated.

When the rideout and the pulley center-to-center distance and variations thereof are determined, the V-belt tension is automatically removed and the V-belt is transferred out of the drive pulley automatically. When values out of the set range are detected which can be corrected by the grinding operation, the belt processing section and push roll section are automatically actuated to effect grinding of the V-belt sides to produce acceptable belts.

The acceptable V-belts are automatically transferred and sorted into preselected groups having similar belt lengths.

Thus, all the mechanisms and components of the apparatus have fully automatic and continuous operation.

The foregoing disclosure of specific embodiments is illustrative of the broad inventive concepts comprehended by the invention.

We claim:

1. Apparatus for sorting power transmission belts having different lengths, said apparatus comprising:

belt drive mechanism including a drive pulley and a driven pulley, means for rotatively driving said drive pulley about a fixed first axis and means for supporting said driven pulley for rotation about a second axis reciprocatively translatable along a guide path toward and from said first axis;

belt supply means for storing a plurality of V-belts;

first transfer means for automatically transferring said belts one at a time to said belt drive mechanism to be entrained about said drive and driven pulleys;

means for causing said belt drive mechanism to drive the belt transferred thereto under a preselected tension;

means for measuring the length of the driven tensioned belt; and second transfer means for automatically transferring the measured belts from the belt drive mechanism to any one of different collecting stations corresponding one each to different preselected ranges of belt lengths, thereby sorting the belts into a plurality of groups of belts each having a different preselected range of lengths when utilized as power transmission belts.

2. The belt sorting apparatus of claim 1 further including means for modifying the cross-sectional configuration of the belts while being driven under tension by said belt drive mechanism to adjust the effective length thereof when the measuring means measures a driven, tensioned belt having an effective length which is shorter than the shortest of the preselected range.

3. The belt sorting apparatus of claim 1 further including grinding means for modifying the cross-sectional configuration of the belts while being driven under tension by said belt drive mechanism to adjust the effective length thereof when the measuring means measures a driven, tensioned belt having an effective length which is shorter than the shortest of the preselected range.

4. The belt sorting apparatus of claim 1 further including grinding means for modifying the cross-sectional configuration of the belts by grinding the sides of the belt while being driven under tension by said belt drive mechanism to adjust the effective length thereof when the measuring means measures a driven, tensioned belt having an effective length which is shorter than the shortest of the preselected range.

5. The belt sorting apparatus of claim 1 wherein said second transfer means comprises a conveyor and a plurality of pickup means associated with said conveyor selectively operable to pick up belts from said belt drive mechanism including a first pickup means arranged to pick up only belts from said belt drive mechanism having an effective length in a first of said preselected ranges of length and a second pickup means arranged to pick up belts from said belt drive mechanism having an effective length in a second of said preselected ranges of length.

6. The belt sorting apparatus of claim 1 wherein said second transfer means comprises a conveyor and a plurality of pickup means associated with said conveyor selectively operable to pick up belts from said belt drive mechanism including a first pickup means arranged to pick up only belts from said belt drive mechanism having an effective length in a first of said preselected ranges of length and a second pickup means arranged to pick up belts from said belt drive mechanism having an effective length in a second of said preselected ranges of length, each of said pickup means comprising a selectively rotatable hanger and means for rotating said hanger into a belt pickup position as a result of said measuring means determining the measurement of the belt in said belt drive mechanism as within the preselected range of lengths corresponding to that assigned to that rotatable hanger.

7. Apparatus for sorting power transmission belts having different lengths, said apparatus comprising:

a belt drive mechanism for driving an unmeasured power transmission belt entrained under tension about a measuring drive pulley carried by a frame for rotation about a first, fixed axis, and a measuring driven pulley rotatable about a second axis movable along a guide rod;

rideout detecting means having a flat roller mounted at the end of a pivotable arm and arranged to be pressed against the outside of the driven power transmission belt at the measuring drive pulley at a preselected tension for measuring the spacing between the outside surface of the belt and the outside surface of the measuring drive pulley;

pulley outside circumference detecting means for detecting the center-to-center distance between the measuring drive pulley and the driven pulley;

belt push-out means for pushing out the measured belt by detaching the measured belt from the measuring drive pulley after the belt length has been measured; and belt catching means for receiving the pushed-out belts.

8. The belt sorting apparatus of claim 7 wherein said pulley outside circumference detecting means includes a rack rod movable with said measuring driven pulley.

9. The belt sorting apparatus of claim 7 wherein said rideout detecting means further includes gear means driven about the axis of pivoting of said pivotable arm for use in indicating said spacing.

10. The belt sorting apparatus of claim 7 wherein said belt push-out means is installed at the end of a pivotable arm one end of which is attached to a frame adjacent to the belt traveling section.

11. The belt sorting apparatus of claim 7 wherein said belt push-out means is provided with a belt push bar located at a lower portion of said measuring drive pulley.

12. The belt sorting apparatus of claim 7 wherein said belt catching means includes a belt hanger pivotably reciprocative between the measuring drive pulley and a position at which said measured belt is received.

13. The belt sorting apparatus of claim 7 wherein said belt catching means includes a belt hanger pivotably reciprocative between the measuring drive pulley and a position at which said measured belt is received, including a stop disposed at said position.

14. The belt sorting apparatus of claim 7 further including a belt processing section having means for horizontally moving a grinder to grind the side surface of said belt.

15. The belt sorting apparatus of claim 7 further including a belt processing section having means for horizontally moving a grinder to grind the side surface of said belt adjacent the measuring drive pulley.

16. The belt sorting apparatus of claim 7 further including a belt processing section having means for horizontally moving a grinder to grind the side surface of said belt, and push roll means for pressing said belt outside surface engaged by said grinder.

17. The belt sorting apparatus of claim 7 further including a belt processing section having means for horizontally moving a grinder to grind the side surface of said belt, and push roll means including movable roller means for pressing said belt outside surface engaged by said grinder.

18. A method of sorting power transmission belts comprising:

hanging a plurality of power transmission belts in a horizontal support;

urging the plurality of belts toward one end of the support to cause the lead belt only to fall therefrom;

guiding the falling belt into a detecting mechanism;

detecting characteristics of the belt in said detecting mechanism;

selectively (a) causing transfer of the belt to a reject position in the event the detected characteristics are outside a first preselected range of values, (b) causing modification of the belt to cause the characteristics thereof to be within a second range of values in the event the detected characteristics are within said first set of values but outside said second range of values; and sequentially collecting from said detecting mechanism all belts having detected characteristics within said second range of values either as originally detected or as detected following such modification.

19. The method of sorting power transmission belts of claim 18 further including the step of sorting the belts collected from the detecting mechanism into groups having different ranges of values within said second range of values.

20. The method of sorting power transmission belts of claim 18 wherein the belt is driven under a preselected tension during the step of detecting the belt characteristics.

* * * * *